US005247803A

United States Patent [19]

Adams et al.

[11] Patent Number: 5,247,803

[45] Date of Patent: Sep. 28, 1993

[54] DUAL TANK REFRIGERANT RECOVERY SYSTEM

[75] Inventors: Kenneth M. Adams, Paris; Ronald E. Keith, Irving, both of Tex.

[73] Assignee: Technical Chemical Corporation, Dallas, Tex.

[21] Appl. No.: 874,617

[22] Filed: Apr. 27, 1992

[51] Int. Cl.[5] ..... F25B 45/00

[52] U.S. Cl. ..... 62/77; 62/149; 62/292

[58] Field of Search ..... 62/77, 84, 149, 292, 62/475; 141/18, 21, 35; 220/565

[56] References Cited

U.S. PATENT DOCUMENTS

| | | | |
|---|---|---|---|
| 4,766,733 | 8/1988 | Scuderi | 62/77 |
| 4,939,905 | 7/1990 | Manz | 62/77 |
| 4,953,357 | 9/1990 | Van Steenborgh | 62/45.1 |
| 4,969,495 | 11/1990 | Grant | 141/98 |
| 4,981,020 | 1/1991 | Scuderi | 62/77 |
| 5,090,211 | 2/1992 | Peters | 62/292 |
| 5,090,212 | 2/1992 | Keltner et al. | 62/149 |
| 5,094,087 | 3/1992 | Gramkow | 62/292 |

*Primary Examiner*—John Sollecito
*Attorney, Agent, or Firm*—Konneker, Bush & Hitt

[57] ABSTRACT

A refrigerant recovery system comprises a compressor driven recovery machine having inlet and outlet ports, a primary refrigerant receiving and storage vessel having liquid and vapor ports, and a secondary refrigerant receiving and storage vessel having an inlet. During the refrigerant recovery process the refrigerant circuit outlet is coupled to the primary vessel liquid port, the primary vessel vapor port is coupled to the recovery machine inlet port, and the recovery machine outlet port is coupled to the vapor inlet of the secondary vessel. Operation of the recovery machine draws liquid refrigerant into the primary vessel at a high flow rate while withdrawing refrigerant vapor from the primary vessel, converting the withdrawn vapor to liquid refrigerant, and forcing the liquid refrigerant into the secondary vessel at a liquid refrigerant flow rate substantially less than the liquid refrigerant inflow rate to the primary vessel. The use of the primary vessel interposed between the refrigerant circuit and the recovery machine greatly increases the machine's refrigerant recovery rate compared to the conventional connection of the machine only to a refrigerant receiving and storage vessel at its outlet end. Each of the vessels is provided with a safety cutoff switch which, via electrical circuitry interconnected between the switches and the machine compressor, operates to shut off the machine compressor when the liquid refrigerant level in the vessel reaches a predetermined maximum level.

7 Claims, 2 Drawing Sheets

DUAL TANK REFRIGERANT RECOVERY SYSTEM

BACKGROUND OF THE INVENTION

The present invention relates generally to the handling of refrigerant, and more particularly relates to apparatus and methods for recovering refrigerant from air conditioning and refrigeration systems for recycling purposes.

Conventional refrigerant recovery systems used to remove refrigerant from air conditioning or refrigeration systems for recycling purposes typically comprise a recovery machine having an inlet port and an outlet port. Operatively disposed between these ports are an accumulator having an inlet connected to the machine inlet port; a condenser having an outlet connected to the machine outlet port; and a compressor having an inlet communicated with the accumulator outlet and an outlet communicated with the inlet of the condenser.

To use the refrigerant recovery machine, its inlet port is connected to an outlet fitting on the air conditioning or refrigeration circuit from which refrigerant is to be recovered, and the machine outlet is connected to the vapor port of a refrigerant receiving and storage tank. Subsequent operation of the machine compressor draws gaseous and liquid refrigerant from the refrigerant circuit and forces it through the condenser and into the storage tank connected to the machine outlet port. When the refrigerant circuit is emptied, the storage tank may be disconnected to permit its received refrigerant to be recycled, or simply left in place to receive another batch of withdrawn refrigerant, depending on the storage tank capacity.

A disadvantage of this conventional single tank recovery system is that the recovery rate of refrigerant forced by the machine compressor into the single tank connected to its outlet port is very slow. For example, a typical recovery rate for this type of machine, when provided with a 0.25 HP compressor, is on the order of 0.33 to 0.5 pounds of refrigerant per minute. Thus, for example, the recovery of a 10 pound charge of refrigerant from an air conditioning circuit normally takes about 20 to 30 minutes, with correspondingly longer time periods for larger charges of refrigerant being withdrawn. Of course, it is possible to increase the recovery rate simply by increasing the size of the compressor. However, this would require that the other components of the recovery machine be correspondingly upsized, thereby undesirably increasing the size, weight and cost of the machine.

From the foregoing it can readily be seen that it would be highly desirable to provide a refrigerant recovery system, preferably utilizing a conventional refrigerant machine of the general type described above, which would significantly increase the refrigerant recovery rate of the machine without increasing the size of its operating components. It is accordingly an object of the present invention to provide such a system and associated refrigerant recovery methods.

SUMMARY OF THE INVENTION

In carrying out principles of the present invention, in accordance with a preferred embodiment thereof, an improved refrigerant recovery system is provided which, compared to conventional refrigerant recovery systems such as the one described in the preceding section, has a substantially increased refrigerant recovery rate per compressor horsepower of the recovery machine incorporated in the system.

The system of the present invention illustratively includes a conventional refrigerant recovery machine of the type having an inlet port and an outlet port; an accumulator having an inlet connected to the machine inlet port; a condenser having an outlet connected to the machine outlet port; and a compressor having an inlet connected to the outlet of the accumulator, and an outlet connected to the inlet of the condenser. The machine outlet port is connected in the usual fashion to the vapor port of a single refrigerant receiving and storage tank, hereinafter referred to as the secondary tank or vessel.

According to a key aspect of the present invention, the machine inlet port is not directly connected to the outlet fitting of the air conditioning or refrigeration circuit from which refrigerant is to be withdrawn by the recovery machine. Instead, a second refrigerant receiving and storage tank (hereinafter referred to as the primary tank or vessel) is provided and operably interposed between the circuit outlet fitting and the machine inlet port by connecting the refrigerant circuit outlet fitting to the liquid port of the primary tank and connecting the machine inlet port to the vapor port of the primary tank. This interposition of the primary tank between the refrigerant circuit and the machine inlet port is preferably accomplished using a combination vapor/liquid port fitting installed on the primary tank.

During operation of the recovery machine compressor, the pressure in the primary tank is lowered to an extent that refrigerant very rapidly enters this tank, while at the same time refrigerant is forced into the secondary tank at a much slower rate, with the flow rate ratio of liquid refrigerant entering the primary tank to that entering the secondary tank being on the order of 6 to 1. Accordingly, using the principles of the present invention, the primary tank is used as the primary recovery vessel—not the secondary tank as under conventional practice. In the system of the present invention, the secondary tank is used merely as an outlet pressure buffer for the recovery machine.

Compared to conventional recovery systems using only the single tank at the outlet end of the recovery machine, the recovery system of the present invention provides a far faster refrigerant recovery rate. As an example, a conventional recovery machine having a 0.25 HP compressor will recover refrigerant, in the primary tank, at the dramatically increased rate of approximately 10 pounds per minute as compared to the typical 0.33 to 0.5 pound per minute refrigerant vapor recovery rate, and approximately 2.5 pound per minute liquid refrigerant recovery rate, of the same machine using only the single tank at its outlet end.

When the primary tank is suitably full, it may be removed from the system to permit recycling of withdrawn refrigerant stored in the primary tank. Since, during recovery machine operation, the secondary tank receives refrigerant at a much slower rate than the primary tank, the secondary tank may be simply be left in place until it eventually is suitably filled with withdrawn refrigerant during subsequent recovery operations using subsequently installed primary tanks as the primary recovery vessels. The secondary tank can then be removed for recycling of its received refrigerant.

According to another feature of the present invention, safety cutoff switches, preferably of the type illustrated and described in U.S. Pat. No. 5,090,212, are installed on the primary and secondary tanks. Each of these cutoff switches is operative to output an electrical safety signal when its associated tank reaches an 80% fill level. Circuit means are interconnected between the switches and the recovery machine compressor, and are operative to terminate compressor operation when either cutoff switch generates its safety output signal.

DETAILED DESCRIPTION

Figure 1:
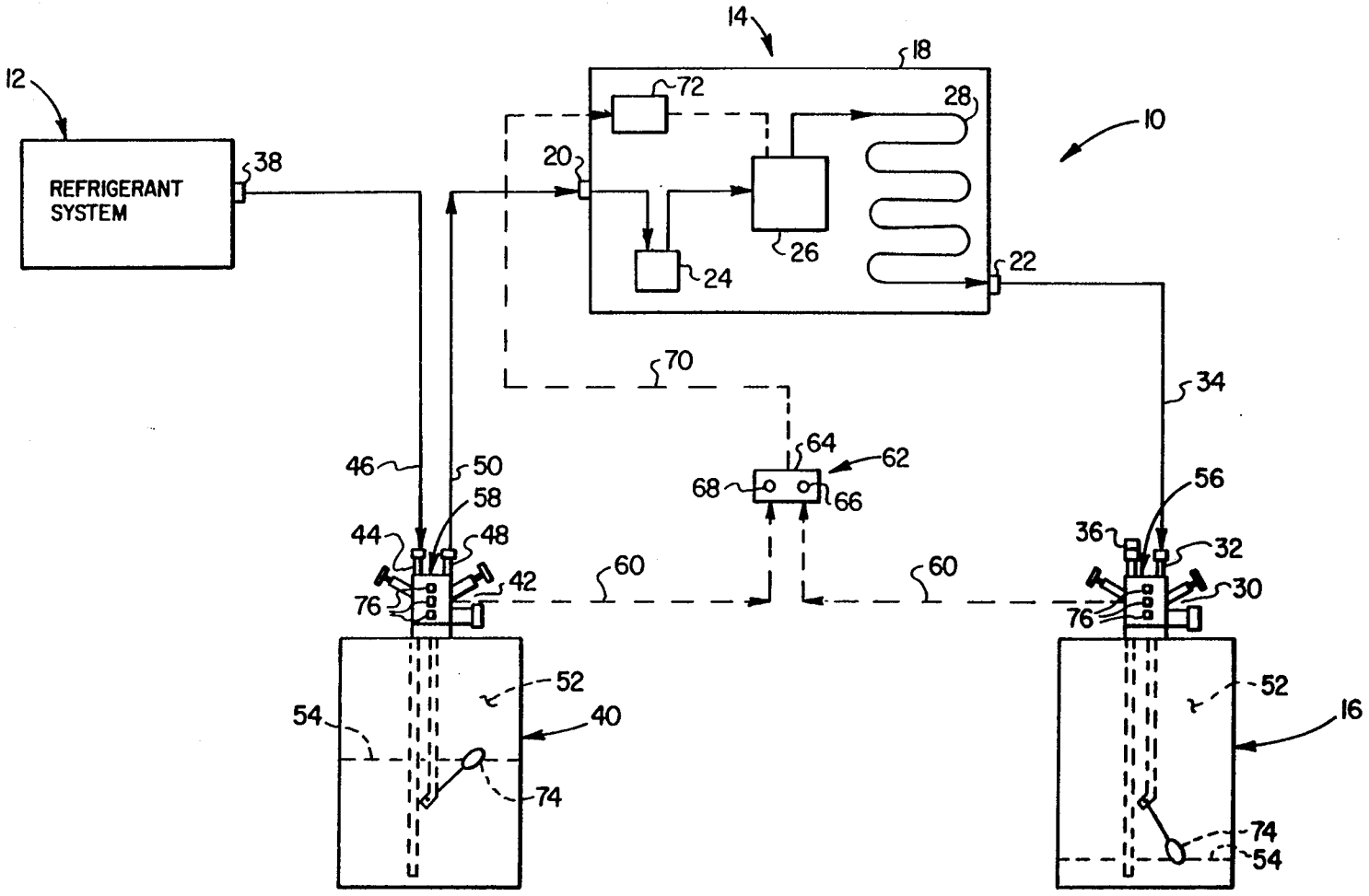
FIG. 1 is a schematic diagram of a dual tank refrigerant recovery system embodying principles of the present invention.

Schematically illustrated in FIG. 1 is an improved closed loop refrigerant recover system 10 which embodies principles of the present invention and is used to rapidly withdraw refrigerant from a refrigerant system 12, such as an air conditioning or refrigeration circuit, and store the recovered refrigerant for subsequent recycling thereof. The refrigerant recovery system 10 includes a generally conventional refrigerant recovery machine 14 and a refrigerant receiving and storage tank 16.

Recovery machine 14 has an outer housing 18 provided with a refrigerant inlet port 20 and a refrigerant outlet port 22. Disposed within housing 18 are an accumulator 24 having an inlet connected to the machine inlet port 20, a compressor 26 having an inlet connected to the accumulator outlet, and a condenser 28 having an inlet connected to the compressor outlet, and an outlet connected to the machine outlet port 22.

Connected to the top end of tank 16 is a combination liquid/vapor fitting 30 having a vapor port 32 connected to the machine outlet port 22 by a conduit 34, and a capped liquid port 36. Under conventional use of the recovery machine 14, its inlet port 20 would be directly connected to the outlet 38 of the system 12 from which refrigerant is to be recovered for recycling purposes. With the recovery machine 14 conventionally coupled directly to the system 12, operation of the compressor 26 draws gaseous and liquid refrigerant into the machine inlet port 20, compresses the received refrigerant, forces the compressed refrigerant through the condenser 28 which cools and liquifies the refrigerant, and then flows the condensed refrigerant into the tank 16, via conduit 34, the liquid refrigerant being collected in the bottom of tank 16 for subsequent removal and reclamation.

As is well known in the refrigerant handling industry, this conventional use of the refrigerant recovery machine 14 to remove refrigerant from the system 12 and deposit the removed refrigerant, in liquid form, in a single receiving tank connected at the outlet end of the recovery machine is a relatively time consuming process. For example, when a 0.25 HP compressor is used in the machine 14, the flow rate of refrigerant discharged into the tank 16 is typically on the order of from about 0.33 pounds per minute to about 0.5 pounds per minute of refrigerant vapor, and approximately 2.5 pounds per minute of liquid refrigerant.

Using the improved recovery system 10 of the present invention, however, the refrigerant recovery rate is dramatically increased without increasing the size of the compressor 26 or the other components of the recovery machine 14. This increase in refrigerant recovery rate is uniquely achieved by the provision of a second refrigerant receiving and storage tank 40 which is representatively identical to the tank 16 and is operatively interposed between the refrigerant system outlet 38 and the recovery machine inlet port 20. Tank 40 is provided at its top end with a combination liquid/vapor fitting 42 having a liquid port 44 connected to the refrigerant system outlet 38 by a conduit 46, and a vapor port 48 connected to the machine inlet port 20 by a conduit 50.

During operation of the compressor 26, the pressure in conduit 50, and thus the pressure in tank 40, is lowered to an extent such that gaseous and liquid refrigerant present in refrigerant system 12 are drawn into the tank 40 through the conduit 46. At the same time, gaseous refrigerant 52 within tank 40 is flowed through the recovery machine 14, compressed, condensed to liquid refrigerant 54 and forced into the tank 16 wherein it is stored together with gaseous refrigerant 52. Importantly, using this unique dual tank recovery system 10, the overall rate of withdrawal of refrigerant from the system 12 is increased to approximately 10 pounds per minute as compared to the approximately 0.33–0.5 pounds per minute vapor recovery rate, and approximately 2.5 pounds per minute liquid refrigerant recovery rate, resulting when, under conventional practice, only the outlet end tank 16 is utilized.

During operation of the recovery machine 14, the liquid refrigerant accumulation rate in the tank 40 is approximately six times the liquid refrigerant accumulation rate in the tank 16. Accordingly, in the improved system 10, the added tank 40 is used as a primary refrigerant recovery and storage vessel. The tank 16, although it also receives and stores withdrawn refrigerant, now plays only a secondary refrigerant receiving and storage role—it functions primarily as an outlet pressure buffer for the compressor 26 The bulk of the recovered refrigerant is captured in the primary tank 40.

When the primary tank 40 is sufficiently filled with recovered liquid refrigerant, it is simply removed from the overall system 10 and taken to a refrigerant reclamation facility. Alternatively, the refrigerant recovered in tank 40 may be recycled on site. The secondary tank 16 will, of course, eventually be filled with recovered refrigerant. At that time, tank 16 may also be removed for recycling of its recovered refrigerant.

With continued reference to FIG. 1, according to another feature of the present invention a pair of safety cutoff switches 56,58 are respectively connected to the combination liquid/vapor fittings 30 and 42 which, like the switches, are substantially identical in construction and operation to those illustrated and described in U.S. Pat. No. 5,090,212 which is hereby incorporated by reference herein. In a manner subsequently described, each of the switches 56,58 is operative to generate an electrical output signal 60 in response to its associated tank becoming 80% filled with liquid refrigerant.

Signals 60 are routed to a signal receiving circuit 62 disposed in a housing 64 upon which a pair of LED indicator lights 66,68 are mounted. Upon receiving either of the signals 60, circuit 62 responsively transmits an electrical signal 70 to an electrical control circuit 72 operatively connected to the compressor 26. Upon receipt of the signal 70, the circuit 72 operates to shut down the compressor 26, thereby preventing the overfilling of either of the tanks 16 and 40.

As illustrated and described in the aforementioned U.S. Pat. No. 5,090,212, each of the combination liquid/vapor fittings 30,42 supports a magnet (not shown herein) for vertical movement controlled by the corresponding vertical movement of a float member 74. Three Hall effect sensors 76 carried by each of the switches 30,42 are operative to detect the vertical position of their associated magnet and responsively output one of the signals 60 when the float-controlled magnet position indicates that their associated tank has reached its predetermined 80% liquid refrigerant fill level.

Figure 2:
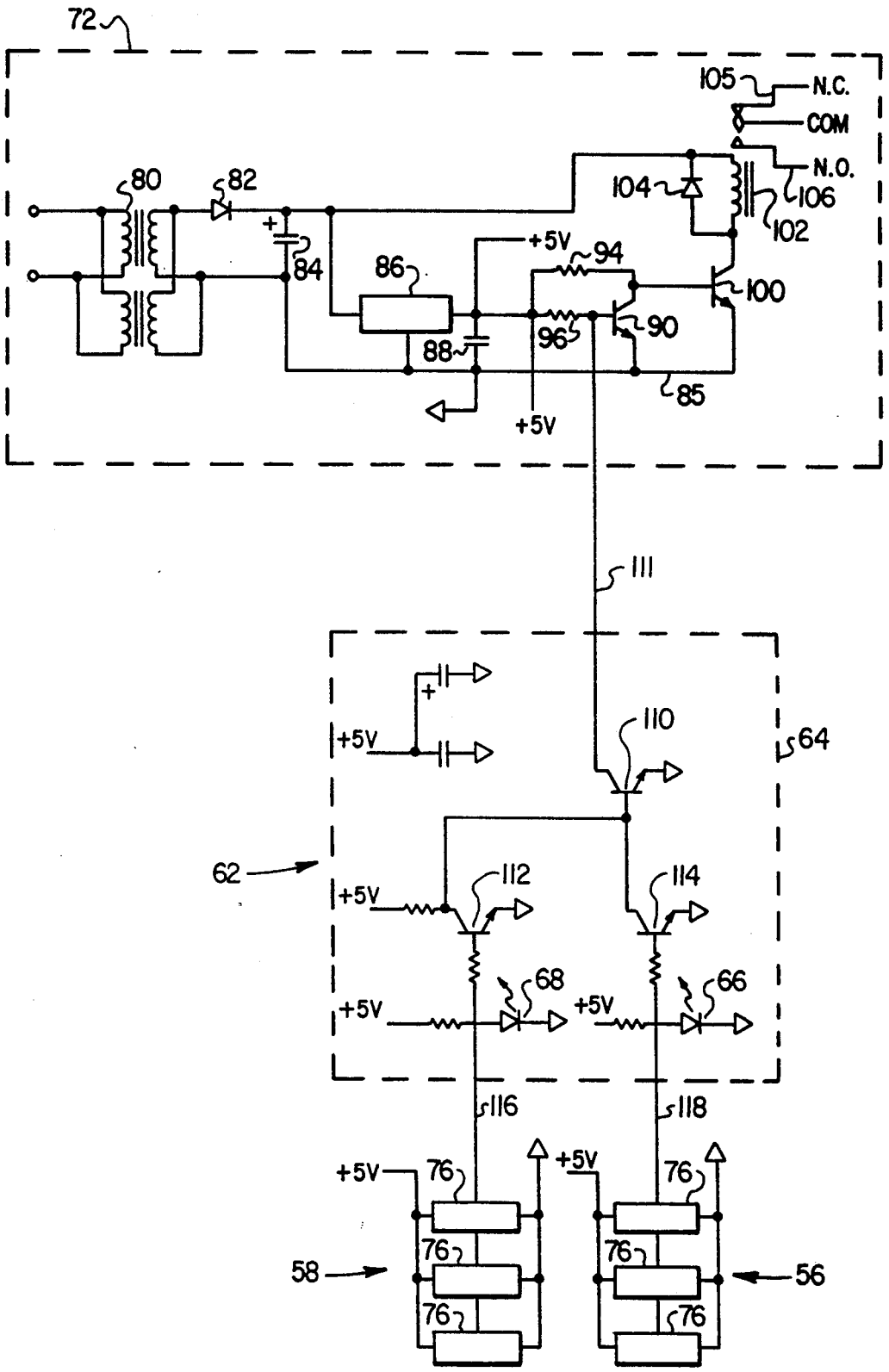
FIG. 2 is a circuit diagram schematically illustrating the electrical interconnection between a pair of refrigerant tank safety cutoff switches and a recovery machine compressor portion of the system.

Turning now to FIG. 2, the control circuit 72 is similar to the single switch control circuit shown in FIG. 5 of U.S. Pat. No. 5,090,212 and includes a transformer 80 that converts line voltage to 24 volts and provides isolation from the line. A diode 82 converts the AC voltage to pulsating DC voltage. A capacitor 84 is connected to the diode 82 for filtering and smoothing the half-wave rectified AC to provide a constant source of DC. Capacitor 84 is connected between the diode 82 and a ground line 85. An integrated circuit 86 connects between the diode 82 and ground line 85. Integrated circuit 86 is a conventional device for regulating the voltage imposed across the capacitor 84 and to provide a steady source of five volts DC. A capacitor 88 provides for stability of integrated circuit 86, and is connected across the output and the ground line 85.

Control circuit 72 also includes a transistor 90 having its collector connected to a resistor 94, its base connected to a resistor 96 in parallel with resistor 94, and its emitter connected to the ground line 85. The collector of transistor 90 is also connected to the base of a transistor 100 having its emitter connected to the ground line 85 and its collector connected to the coil of a relay 102 connected in parallel with a diode 104. Relay 102 is used to permit and terminate operation of the recovery machine compressor 26 and has two stationary contacts, one connected to a normally closed line 105, and the other connected to a normally open line 106. The relay 102 contacts will connect a movable common line 108 to the normally closed line 105 when current is not flowing. If current flows in the coil of relay 102, the resulting magnetic field will move the contacts. If current flows, the contact of the normally closed line 105 disconnects from connection with the common line 108. Diode 104 is a protection device that absorbs the transient voltage spike that is generated by the collapse of the magnetic field in the coil 102 when current is interrupted.

The receiving circuit 62 includes a transistor 110 whose collector is connected to the circuit 72 between the resistor 96 and the base of the transistor 90 by a lead 111 through which the signal 70 (FIG. 1) is transmitted. The base of transistor 110 is connected as shown to the collectors of a pair of transistors 112,114. The three Hall effect sensors 76 in each of the safety cutoff switches 56,58 are connected in parallel as shown, and have output leads 116,118 (through which the signals 60 are generated) respectively connected to the bases of the transistors 112,114 and the LED indicator lights 68,66. The transmission of an output signal 60 through either of the leads grounds either transistor 112 or transistor 114. Transistor 110 will remain switched off, thereby allowing 5 volts to remain on line 111, thus effectively grounding transistor 90. The grounding of transistor 90 prevents current from flowing through the coil 102, thereby opening the relay switch and shutting down the compressor 26.

The foregoing detailed description is to be clearly understood as being given by way of illustration and example only, the spirit and scope of the present invention being limited solely by the appended claims.

What is claimed is:

1. An improved system for recovering refrigerant from a refrigerant circuit having an outlet through which refrigerant may be withdrawn from said circuit, said system comprising:

a refrigerant recovery machine having an inlet port for receiving refrigerant, an outlet port for discharging the received refrigerant, and means, including a compressor, for forcibly flowing the received refrigerant from said inlet port to said outlet port;

a first refrigerant receiving vessel;

means for connecting said first refrigerant receiving vessel to said outlet port in a manner such that during operation of said refrigerant recovery machine said first refrigerant receiving vessel receives and is progressively pressurized by and filled with refrigerant discharged from said compressor;

a second refrigerant receiving vessel;

means for communicating the interior of said second refrigerant receiving vessel with said refrigerant circuit outlet and said refrigerant recovery machine inlet port in a manner such that operation of said refrigerant recovery machine withdraws refrigerant from said circuit and causes the withdrawn refrigerant to accumulate in said second refrigerant receiving vessel at a substantially greater rate than in said first refrigerant receiving vessel; and means for automatically terminating the operating of said refrigerant recovery machine in response to the sensed accumulation in either of said first and second refrigerant receiving vessels of a predetermined maximum amount of liquid refrigerant, said means for automatically terminating the operation of said refrigerant recovery machine including:

first cutoff switch means associated with said first refrigerant receiving vessel and operative to output a first electrical signal when the level of accumulated liquid refrigerant in said first refrigerant receiving vessel reaches a predetermined height therein, second cutoff switch means associated with said second refrigerant receiving vessel and operative to output a second electrical signal when the level of accumulated liquid refrigerant in said second refrigerant receiving vessel reaches a predetermined height therein, and electrical circuit means interconnected between said compressor and said first and second cutoff switch means and operative to terminate operation of said compressor in response to the receipt of either of said first and second electrical signals.

2. The improved system of claim 1 wherein:

said second refrigerant receiving vessel has operatively mounted thereon a combination liquid/vapor fitting having a vapor port and a liquid port, and said means for communicating include means for communicating said liquid port with said outlet of said refrigerant circuit, and means for communicating said vapor port with said inlet port of said refrigerant recovery machine.

3. The improved system of claim 1 wherein:

said first refrigerant receiving vessel has operatively mounted thereon a combination liquid/vapor fitting having a vapor port, and said means for connecting include means for connecting said vapor port to said outlet port of said refrigerant recovery machine.

4. The improved system of claim 1 wherein, for each of said first and second refrigerant receiving vessels, said predetermined maximum amount of refrigerant is approximately 80% of the total liquid refrigerant holding capacity of the vessel.

5. The improved system of claim 1 wherein:

each of said first and second cutoff switch means includes a magnet supported for vertical movement relative to its associated vessel, a float member connected to said magnet and operative to vertically move it in response to changes in the level of liquid refrigerant in the vessel, and a plurality of Hall effect sensors operative to sense the vertical height of said magnet.

6. A method of rapidly recovering refrigerant from a refrigerant circuit having an outlet through which refrigerant may be withdrawn from said circuit, said method comprising the steps of:

providing a first refrigerant receiving vessel having an inlet port thereon;

providing a second refrigerant receiving vessel having an inlet port and an outlet port thereof;

providing a compressor powered refrigerant recovery machine having an inlet port and an outlet port;

connecting the refrigerant recovery machine outlet port to the inlet port of said first refrigerant receiving vessel;

connecting the inlet port of said second refrigerant receiving vessel to the outlet of said refrigerant circuit;

connecting the outlet port of said second refrigerant receiving vessel to the inlet port of said refrigerant recovery machine;

starting said refrigerant recovery machine; and automatically stopping said refrigerant recovery machine in response to the liquid refrigerant level in either of said first and second refrigerant recovery vessels reaching a predetermined maximum level, said step of automatically stopping said refrigerant recovery machine being performed by stopping the compressor of said refrigerant recovery machine in response to the output signal of either of a pair of float actuated electric safety cutoff switches operatively connected to said first and second refrigerant receiving vessels.

7. A method of rapidly recovering refrigerant from a refrigerant system having an outlet through which refrigerant may be withdrawn therefrom, said method comprising the steps of:

providing first and second refrigerant receiving vessels each having an inlet and an outlet;

providing a compressor powered refrigerant recovery machine having an inlet and an outlet;

connecting to the refrigerant system outlet, in series therewith, said refrigerant recovery machine and said first and second refrigerant receiving vessels to form at the refrigerant system outlet a refrigerant recovery circuit in which said first refrigerant vessel inlet is connected to said refrigerant recovery machine outlet, said second refrigerant receiving vessel outlet is connected to said refrigerant recovery machine inlet, and said second refrigerant receiving vessel inlet is connected to the refrigerant system outlet;

running said refrigerant recovery machine to remove refrigerant from the refrigerant system, cause a first quantity of the removed refrigerant to be forced into and retained within said first refrigerant receiving vessel, and cause a second, substantially greater second quantity of the removed refrigerant to be drawn into and retained within said second refrigerant receiving vessel;

stopping the refrigerant recovery machine; and recovering the substantially greater second quantity of the removed refrigerant by removing said second refrigerant receiving vessel from said refrigerant recovery circuit to permit subsequent recycling access to the removed refrigerant therein.

* * * * *